US005911593A

United States Patent [19]

Glaser et al.

[11] Patent Number: 5,911,593

[45] Date of Patent: Jun. 15, 1999

[54] ELECTRICAL CONDUCTOR TERMINAL AND A METHOD OF CONNECTING AN ELECTRICAL CONDUCTOR TO A TERMINAL

[76] Inventors: Lawrence F. Glaser, 10705 Averett Dr., Fairfax Station, Va. 22039; Brian E. Stowers, 8315 Botsford Ct., Springfield, Va. 22152

[21] Appl. No.: 08/688,005

[22] Filed: Jul. 29, 1996

[51] Int. Cl.[6] ..... H01R 4/24

[52] U.S. Cl. ..... 439/395

[58] Field of Search ..... 439/395, 402, 439/404, 405, 408, 443, 396; 29/857, 863, 867

[56] References Cited

U.S. PATENT DOCUMENTS

| | | | |
|---|---|---|---|
| 2,694,189 | 11/1954 | Wirsching | 439/403 |
| 3,854,114 | 12/1974 | Kloth et al. | 439/395 |
| 3,932,017 | 1/1976 | Dechelette | 439/443 |
| 4,169,646 | 10/1979 | Stape et al. | 439/402 |
| 4,350,405 | 9/1982 | Yapoudjian et al. | 439/402 |
| 4,421,374 | 12/1983 | Montilla, Jr. | 439/408 |
| 4,448,472 | 5/1984 | Hardesty | 439/408 |
| 4,653,830 | 3/1987 | Pegram | 439/395 |
| 4,755,151 | 7/1988 | Beaulieu et al. | 439/395 |
| 5,080,606 | 1/1992 | Burkard | 439/403 |

*Primary Examiner*—Gary Paumen
*Assistant Examiner*—Tho D. Ta
*Attorney, Agent, or Firm*—Sixbey, Friedman, Leedom & Ferguson, PC; Eric J. Robinson

[57] ABSTRACT

A terminal for connecting electrical conductors which cleaves the electrical conductor as it is connected to the terminal without the use of an additional tool. The terminal includes at least one support post having a slot for receiving an electrical conductor, wherein the electrical conductor is lodged in the slot to create an electrical connection between the conductor and the support post. As the electrical conductor is lodged in the slot, the conductor is cleaved on one side of the slot during the same motion by the installer of lodging the conductor in the slot. The terminal also includes a pivotal tab connected to the slot which may be moved by the hands of an installer to release the connection between the conductor and the slot to allow easy removal and replacement of the conductor. The terminal allows electrical conductors to be installed, cleaved, and removed by the hands of an installer without the use of any tools.

16 Claims, 11 Drawing Sheets

FIG.5
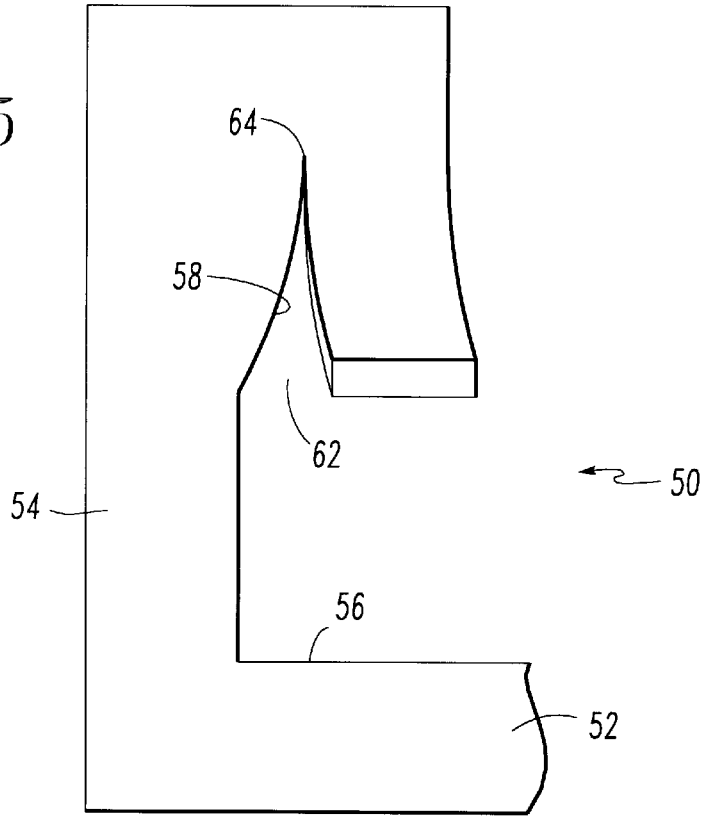
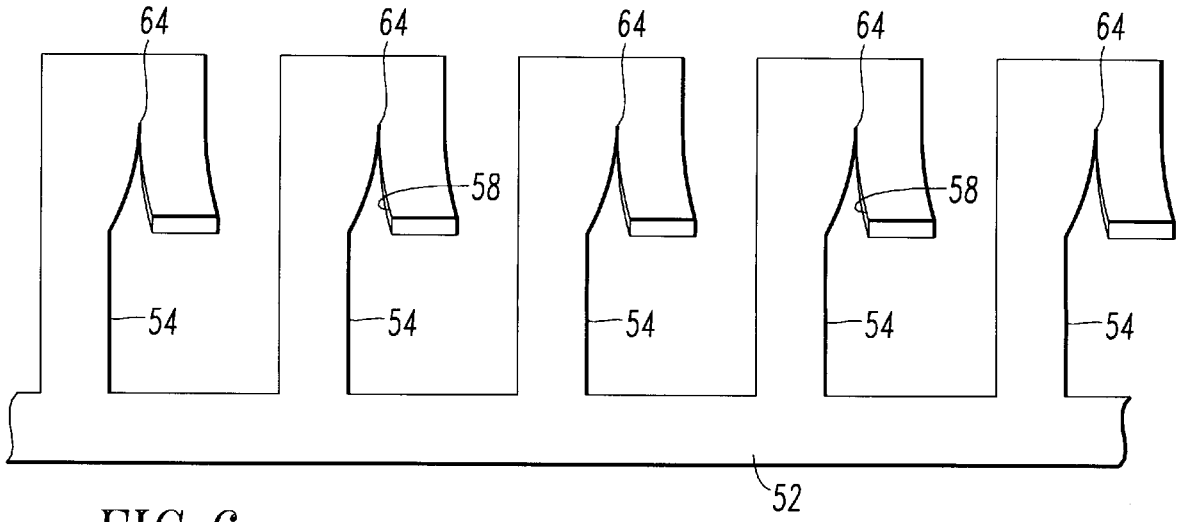
FIG.6

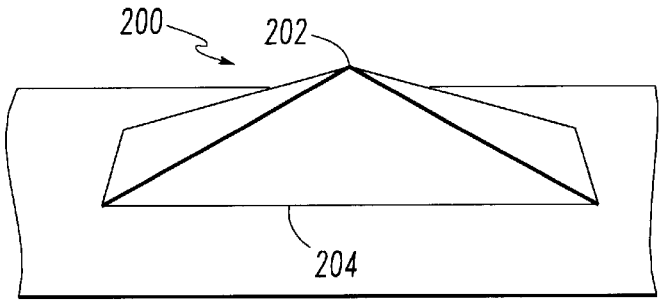
FIG. 14
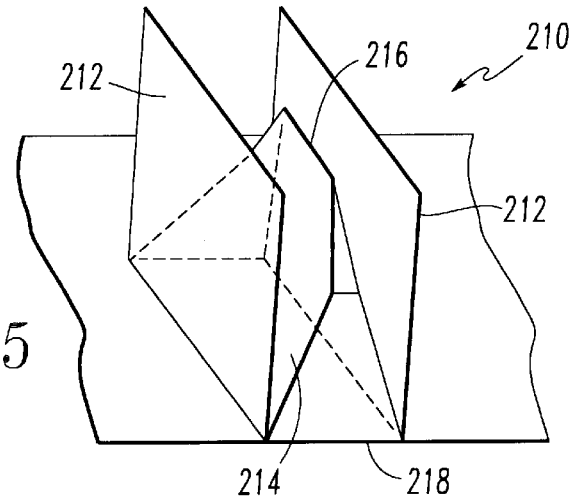
FIG. 15
FIG. 16
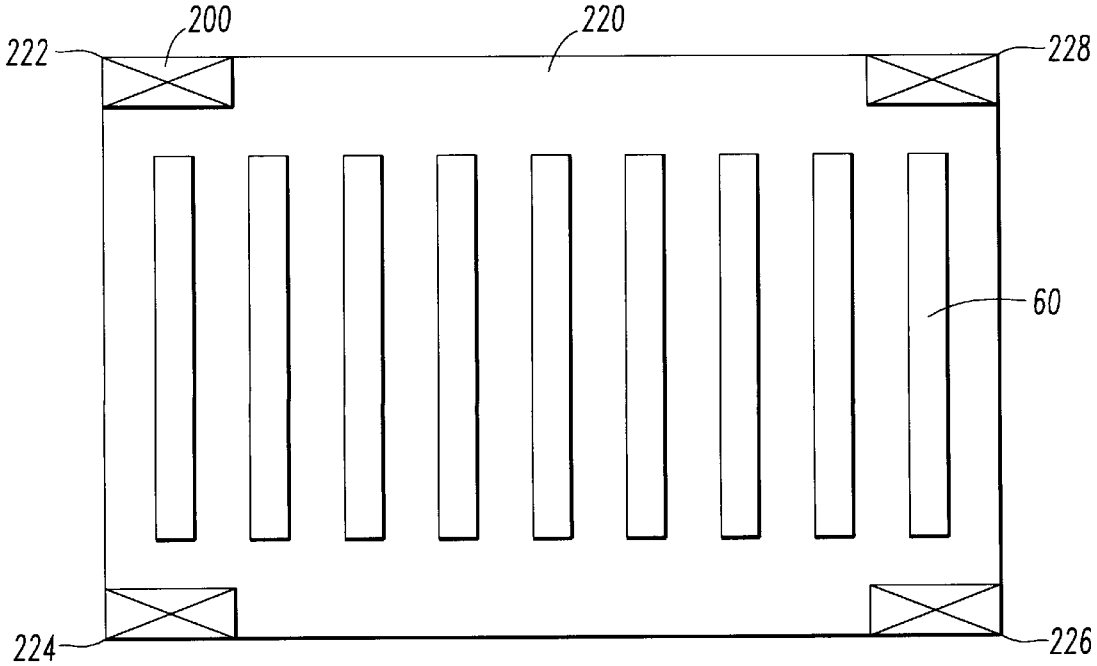

ELECTRICAL CONDUCTOR TERMINAL AND A METHOD OF CONNECTING AN ELECTRICAL CONDUCTOR TO A TERMINAL

BACKGROUND OF THE INVENTION

TECHNICAL FIELD

The present invention relates to a terminal for interconnecting electrical conductors and a method for connecting an electrical conductor to a terminal. More particularly, the present invention relates to a terminal which strips insulation from electrical conductors as well as cleaving excess portions of the electrical conductors in the same step while connecting the electrical conductors to the terminal.

BACKGROUND ART

Electrical connections are typically made by soldering individual leads or wires to terminal posts. In some applications, however, soldered connections are impractical. If, for example, the electrical connection is relatively temporary, the time required to solder each connection is not justified. Additionally, the relative permanence of a soldered connection detrimentally affects the reusability of the connected components. Consequently, a variety of solderless electrical connectors have been developed in an attempt to solve these problems, such as screw-type and spring clip-type connectors.

Currently, the telephone industry also utilizes spring clip-type solderless electrical connectors to connect telephone lines, wherein two specific spring clip-type connectors are the most widely used. The first connector, known as a "110" connector, is manufactured by AT&T. A "110" connector 10, shown in FIG. 1, includes a plurality of spring clips 12 affixed to a plastic housing 14. Each individual spring clip 12 includes a pair of prongs 16 and 18 extending from both ends of the spring clip 12, shown in FIG. 2, wherein the spring clips are situated within the plastic housing 14 such that prongs 16 and 18 are situated between posts 20 in the housing 14. A telephone wire is attached to connector 10 by placing the wire between the prongs 16 and 18 in spring clip 12. If the wire is insulated, the insulation is stripped from a portion of the wire and the stripped portion is placed between prongs 16 and 18, or the unstripped wire is forced between the prongs 16 and 18 with an insertion tool, wherein the insulation is displaced and the connection is made. A trimming tool that fits over the posts 20 is then used to push the wire toward the housing 14 to secure it between prongs 16 and 18, wherein the tool includes a blade that cleaves the wire as it is pushed against housing 14.

The second connector, known as a "66" connector, is manufactured by Siemon Co., Reliable Electric Co., and Cook (Northern Telecom). The "66" connector terminal 22, shown in FIG. 3, includes a plurality of rows of spring clip plates 24 positioned in a base 26. A spring clip plate 24, shown in FIG. 4, includes four spring clips 28 defined by prongs 30 and 32. A wire is connected to terminal 22 by placing the wire in spring clip 28 between prongs 30 and 32. If necessary, the insulation is stripped from a portion of the wire and the stripped portion of the wire is placed in spring clip 28, or the unstripped wire is forced between the prongs 30 and 32 with an insertion tool, wherein the insulation is displaced and the connection is made. A tool that fits over clip 28 is then used to push the wire toward base 26 to secure it between prongs 30 and 32. The tool includes a blade that cleaves the wire as it is pushed against base 26.

As described above, a trimming tool must be used to connect a wire to either a "66" or "110" connector terminal to cleave the wire, thus terminating the wire at the connector terminal. It also may be necessary to strip insulation from a portion of the wire before connecting the wire to either a "66" or "110" connector terminal. These steps can be quite burdensome and require a significant amount of time to perform. Both of these prior connectors share a common flaw of damaging the housing during cleaving, as the cleaving tool imparts a nick or depression into the surface of the housing. As a result, any attempt to reuse the connector is usually futile in that when the cleaving tool is used a second time, it merely pushes the wire into the previously created nick. Also, the blade on the cleaving tool can be damaged by hitting the terminal itself, thus rendering the tool ineffective. Consequently, especially in larger telephone systems, the cost of the labor required to install a system using these connector terminals is high. In addition, the gage of conductor or wire that can be used with a particular "66" or "110" connector is generally limited to a narrow range.

Other connecting terminals are known which allow an insulated wire conductor to be connected to the terminals without requiring a prior step of stripping insulation from the wire. Examples of such insulation displacing terminals are disclosed in U.S. Pat. No. 4,037,905 to Lucas, U.S. Pat. No. 4,272,147 to Berglund et al., U.S. Pat. No. 4,909,754 to Paradis, and U.S. Pat. No. 4,952,169 to Hayes, Sr. Connecting terminals of this type generally include a rigid slot in which the wire conductor is received, wherein the edges of the slot strip the insulation from the wire conductor and form a connection between the wire conductor and the edges of the slot as the wire conductor is forced into the slot. However, these insulation displacement connecting terminals also require the use of a trimming tool to terminate the wire conductor at the connecting terminal, which as described above adds a significant amount of time and cost to the installation procedure as well as wear and tear on the tool. The gage of wire conductor that can be used with the rigid slots in these connecting terminals is also generally limited to the size of the slots.

U.S. Pat. No. 2,694,189 issued to Wirsching discloses a solderless wire terminal having an inverted "V"-shaped slot for receiving an insulated wire, wherein the "V" slot strips the insulation and makes electrical contact with the wire as the wire is inserted in the slot. While the "V" shaped slot is more accommodating for different gages of wire, this wire terminal also requires the use of an additional tool to cleave and terminate the wire at the wire terminal, such as a wire cutter. Furthermore, in all of the above-described connection terminals in which a wire is forced into a received slot, it can be difficult or impossible to dislodge the wire from the slot in order to remove the wire when the terminal is reused and the wire connection is changed.

Accordingly, there is clearly a need for a wire conductor terminal which cleaves and terminates the wire as the wire is connected to the terminal without the need for an additional step of using a trimming tool to cleave the wire. Further, there is a need for a wire conductor terminal which easily facilitates the removal of a previously connected wire from the wire conductor terminal.

SUMMARY OF THE INVENTION

It is an object of the present invention to overcome the aforementioned shortcomings associated with the prior art.

Another object of the present invention is to provide a wire conductor terminal which cleaves and terminates a wire as the wire is connected to the terminal without the need for an additional step of using a trimming tool to cleave the wire.

A further object of the present invention is to provide a wire conductor terminal having a wire release feature which facilitates the removal of a previously connected wire from the wire conductor terminal by releasing the connection and allowing the terminal to be reused.

Yet another object of the present invention is to provide a wire conductor terminal that reduces the time it takes to connect a conductor to the terminal by eliminating the need to use a tool to terminate or cleave the conductor and by eliminating the need to strip insulation from the conductor.

Yet a further object of the invention is to provide a wire conductor terminal which may connect a wide variety of wire conductor gages.

It is yet another object of the invention to provide a quick and efficient method for connecting a wire conductor to a terminal that does not require the use of any tools or any preparation of the conductor.

Still another object of the present invention is to provide a quick and efficient method for connecting a wire conductor to a terminal by having the installer simply pull the wire conductor away from the terminal base.

These as well as other objects and advantages of the present invention are achieved by producing a terminal for connecting electrical conductors including a base and at least one support post affixed to the base. The support post includes a tapered slot for receiving an electrical conductor therein, where the electrical conductor is lodged in the slot by applying a force on the electrical conductor toward a closed end of the slot. Once secured in the slot, an electrical connection is provided between the electrical conductor and the support post through the sides of the slot. The slot further includes a cleaving portion for shearing a segment of the electrical conductor which is not lodged in the slot from the segment which is lodged in the slot, wherein the wire conductor is cleaved as it is lodged in the slot. In one preferred embodiment, the slot is disposed in the support post such that an open end of the slot is directed toward the base, and the electrical conductor is lodged in the slot by applying a force on the electrical conductor in a direction away from the base.

In order to accommodate a wide variety of electrical conductor gages, the slot is tapered from its open end toward its closed end. The slot further displaces insulation surrounding an insulated electrical conductor as the insulated electrical conductor is forced into the slot without the need for any additional insulation stripping tools. In another preferred embodiment of the present invention, the cleaving portion of the slot is formed by tapering one edge of the slot at a greater rate than the other edge of the slot, wherein the side surfaces of the slot will approach the more tapered edge of the slot along a substantially asymptotic curve. That is, the slot is substantially V-shaped and is formed such that it tapers both from (1) a top of the slot toward a bottom of the slot, and (2) from a front of the slot toward a back of the slot.

In an alternative embodiment of the present invention, the electrical conductor terminal further includes a releasing device which releases the electrical conductor from its lodged connection within the slot. The releasing device may include an elongated tab extending from the base and arranged adjacent to the support post, wherein the tab is movable along the longitudinal direction of the slot while being immobile along the lateral direction of the slot. In this embodiment, the elongated tab forms one of the side surfaces of the slot.

The electrical conductor is connected to the terminal having the configuration described above by first disposing the electrical conductor in the slot, and then applying a force on the electrical conductor in a direction toward the closed end of the slot. The force being applied should be sufficient enough to lodge the conductor in the slot to create an electrical connection between the electrical conductor and the support post. The application of such force should be maintained until the cleaving portion of the slot shears the unlodged portion of the electrical conductor from the lodged portion. Once connected, the electrical conductor may be released from its lodged connection with the slot by moving the elongated tab forming a side surface of the slot along a longitudinal direction of the slot to release the compressional forces being applied by the side surfaces of the slot on the electrical conductor or by simply pulling the electrical conductor in the direction in which the tab moves away from the slot in order to dislodge the wire from the terminal.

BRIEF DESCRIPTION OF THE DRAWINGS

FIG. 5 is a perspective view of an individual electrical conductor terminal in accordance with one embodiment of the present invention.

FIG. 6 is a perspective view of a row of electrical conductor terminals in accordance with one embodiment of the present invention.

FIG. 14 is perspective view of one embodiment of the twisted wire pair shaper of the present invention.

FIG. 15 is perspective view of an alterative embodiment of the twisted wire pair shaper of the present invention.

FIG. 16 is a top view of the non-conductive supporting structure of the present invention including the location of the wire shaper of FIG. 14.

DETAILED DESCRIPTION OF THE PREFERRED EMBODIMENTS

Figure 1:
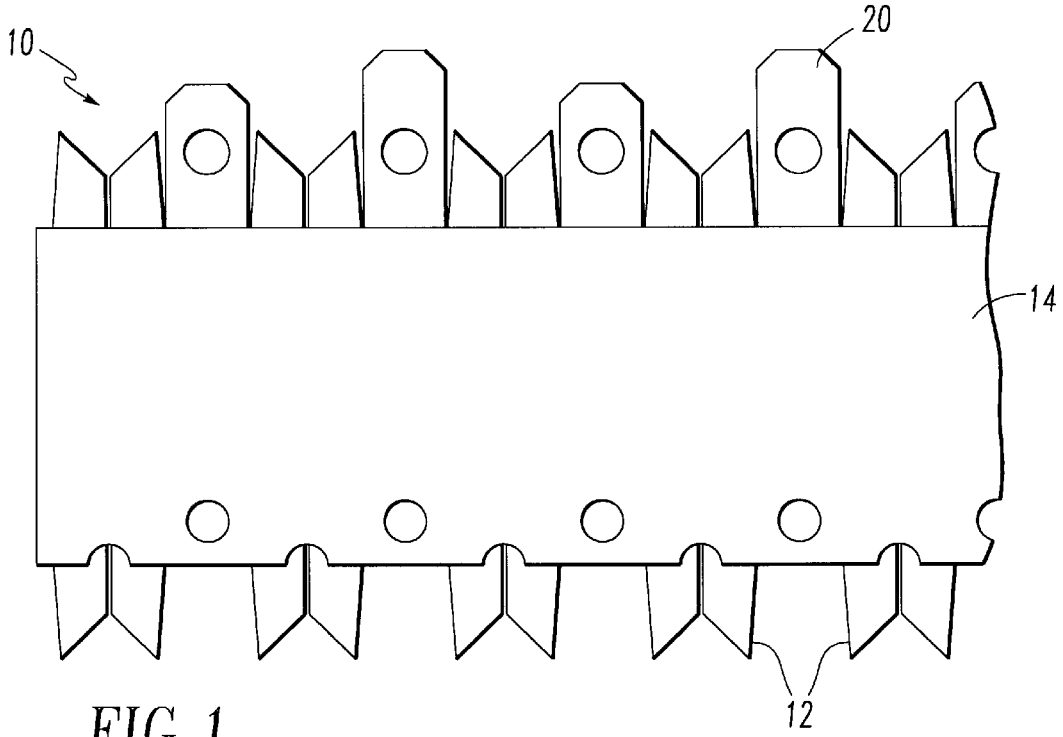
FIG. 1 PRIOR ART
FIG. 1 is a side view of a prior art "110" connector terminal.
Figure 2:
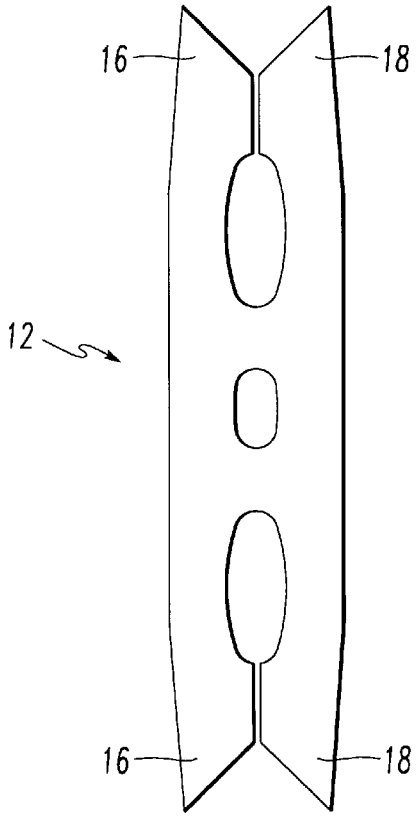
FIG. 2 PRIOR ART
FIG. 2 is a side view of an individual spring clip used in the prior art connector terminal shown in FIG. 1.
Figure 3:
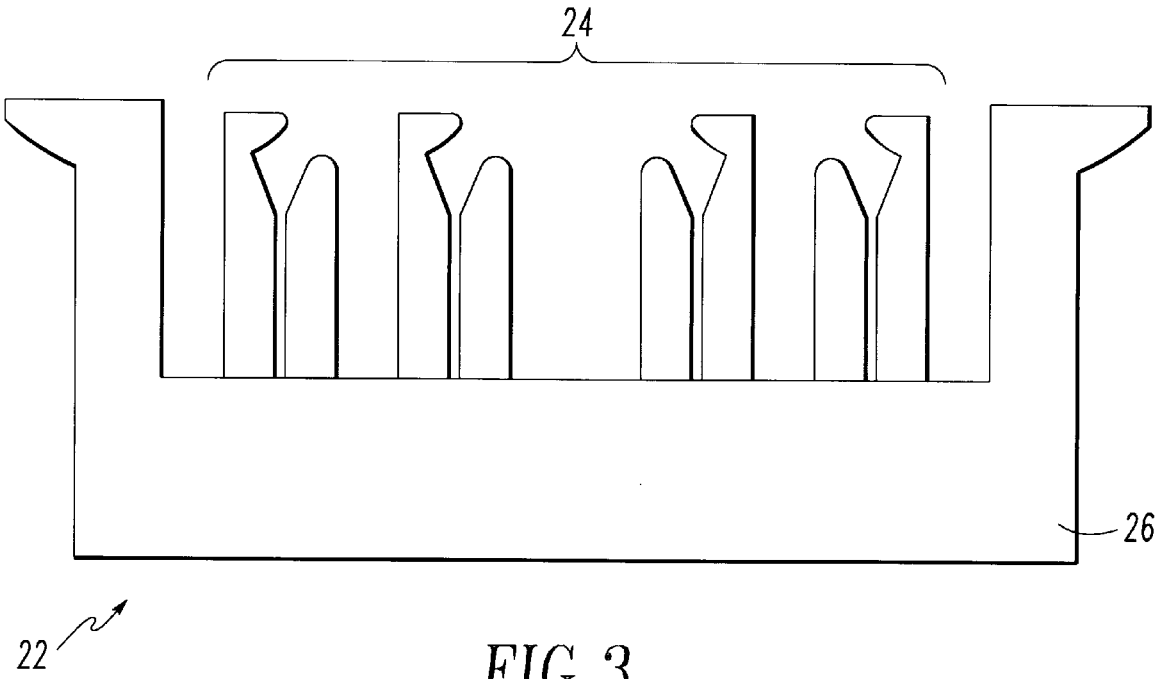
FIG.3 PRIOR ART
FIG. 3 is a side view of a prior art "66" connector terminal.
Figure 4:
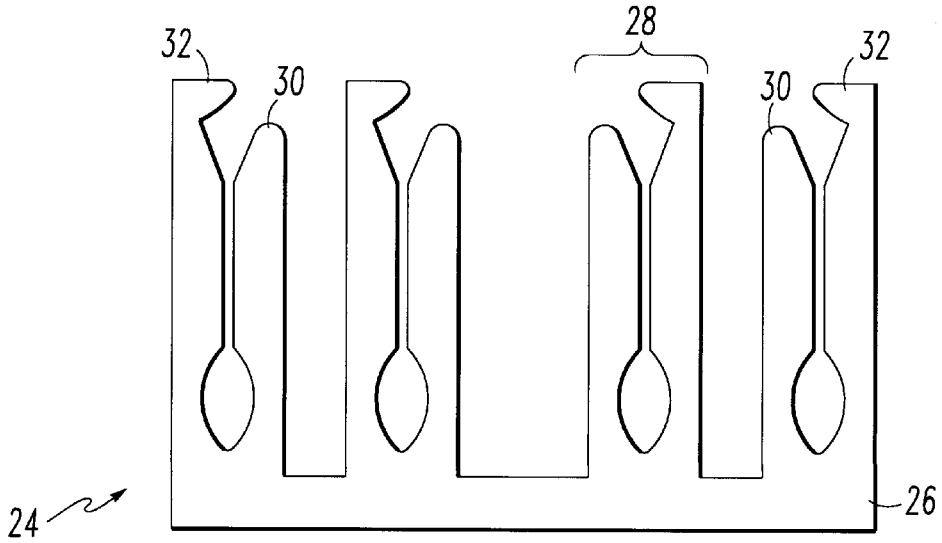
FIG.4 PRIOR ART
FIG. 4 is a side view of an individual spring clip plate used in the prior art connector terminal shown in FIG. 3.

Referring now to FIG. 5, the terminal 50 for connecting electrical conductors in accordance with one embodiment of the present invention is illustrated. The terminal 50 includes a base 52 and at least one support post 54 extending from an upper surface 56 of the base. Each support post 54 includes a slot 58 for receiving an electrical conductor therein, such as a wire or electrical lead. The support post 54 may be made from any suitably conductive material, but preferably is made from copper-based alloys such as phosphor bronze. The support post 54 may be integrally formed with base 52 or attached together by any other means, as long as there is an electrically conductive connection between the support post 54 and base 52. While the support post 54 is illustrated as forming a 90° angle with base 52, it is understood that support post 54 may extend at any angle from base 52 which allows the electrical conductor terminal to function as discussed hereinafter. The terminal 50 will also preferably include a non-conductive supporting structure (not shown) for containing the support post 54 and base 52, wherein the non-conductive supporting structure may be made from any suitable material including, but not limited to, rigid, non-conductive plastics.

In one preferred embodiment of the present invention, a plurality of support posts 54 are situated in a row of support posts 60 extending from the base 52, as illustrated in FIG. 6. This arrangement allows a plurality of electrical conductors connected within the slots 58 of different support posts 54 to be conductively interconnected through conductive base 52. A plurality of rows 60 may be situated within the non-conductive supporting structure to connect a large number of electrical conductors.

In order to form the electrical connection between the electrical conductor and the support post 54, the electrical conductor is lodged in slot 58. In the preferred embodiment of the present invention, the slot 58 is inverted and disposed in the support post 54 so that an open end 62 of slot 58 is facing the base 52. Thus, when force is applied on a conductor to lodge it in slot 58, the direction of the force applied on the conductor is generally away from the base 52, wherein the directional force applied away from the base 52 includes any directions that have a directional component perpendicular to and away from the surface of the base 52. In alternative embodiments of the present invention, the slot 58 may be otherwise situated within support post 54 so that the open end 62 of the slot 58 is not directed toward the base 52. In such alternative embodiments, the direction of force applied to the conductor to lodge it within slot 58 is toward the closed end 64 of the slot 58.

Figure 7:
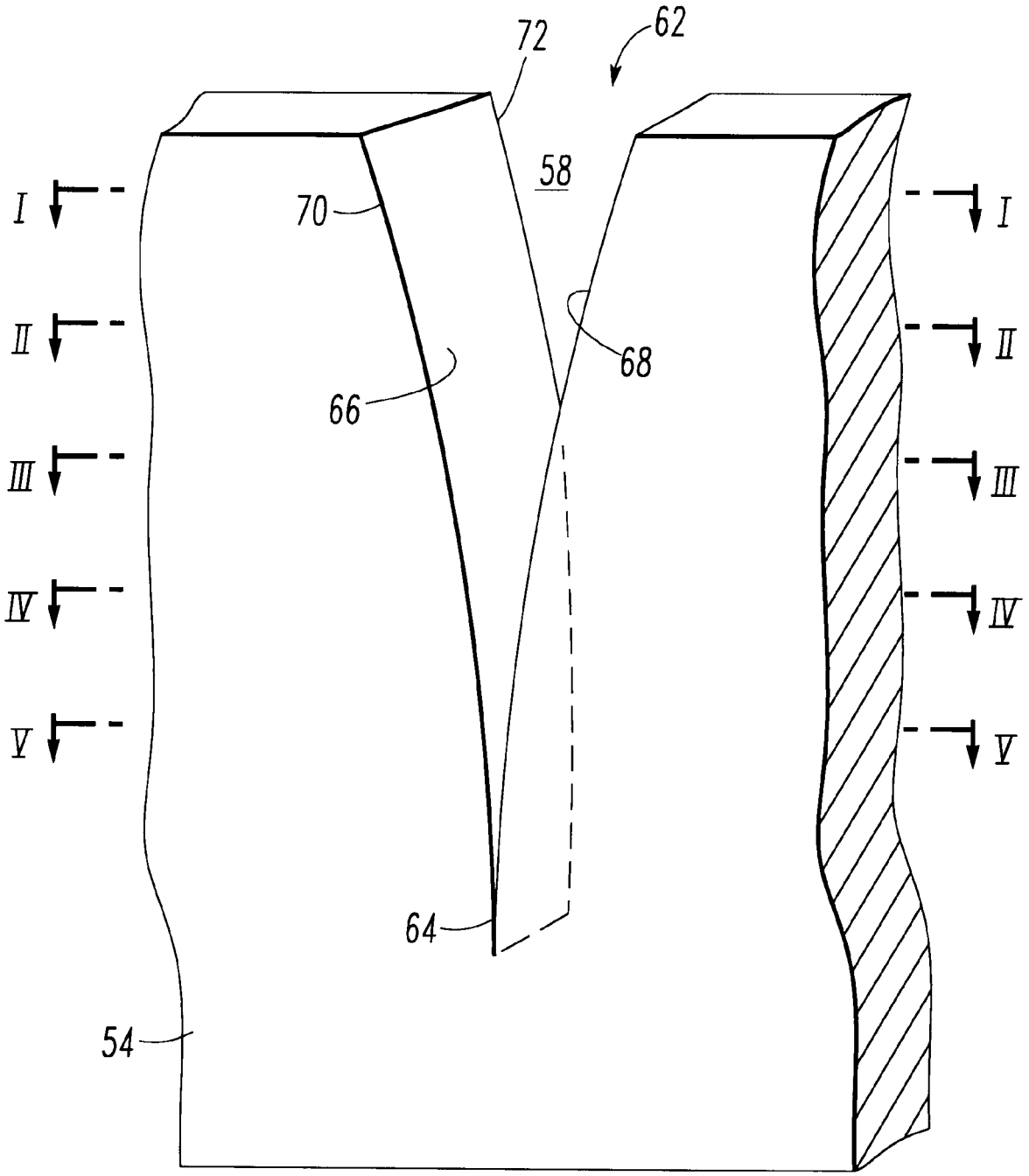
FIG. 7 is a enlarged, fragmentary, perspective side view of the slot of the electrical conductor terminal in accordance with one embodiment of the present invention.

The slot 58 in support post 54 will now be described in greater detail with reference to FIG. 7, which illustrates an enlarged perspective view of the slot 58 area in support post 54. Slot 58 is defined by opposing slot surfaces 66 and 68, wherein slot surfaces 66 and 68 are tapered from the open, or top, end 62 of the slot toward the closed, or bottom, end 64. In the preferred embodiment of the present invention, a first, or front, edge 70 of the slot 58 tapers more quickly than a second, or back, edge 72 of the slot 58. Therefore, as the slot surfaces 66 and 68 approach the closed end 64 of the slot 58, the slot surfaces 66 and 68 travel along a substantially asymptotic curve toward the first edge 70 of the slot. As a result of the substantially asymptotic shape of slot surfaces 66 and 68, the distance between slot surfaces 66 and 68 gradually decreases as closed end 64 is approached with the distance between slot surfaces 66 and 68 decreasing more quickly on the first edge 70 of the slot 58 than on the second edge 72. That is, in addition to tapering from the top end 62 to the bottom end 64, slot 58 also tapers from a back edge 72 to a front edge 70. Thus, a conductor is increasingly compressed as it approaches closed end 64 of slot 58, while also being compressed more on the first edge 70 of the slot 58 than on the second edge 72. Consequently, conductors of varying gages and cross-sections can be firmly and securely lodged in slot 58 to create a stable electrical connection, since the conductor will simply resist further compression once securely lodged in slot 58. Those skilled in the art will recognize that the benefits of the invention may be realized using slots having other shapes such as, for example, V-shaped or U-shaped slots. Furthermore, the tapered shape of the slot 58 may be formed by only sloping one of the slot surfaces 66 and 68 while the other slot surface is substantially linear.

As the electrical conductor is forced into slot 58, the electrical conductor will become compressed and lodged within the slot 58 when the thickness of the conductor is greater than the distance between the slot surfaces 66 and 68. Since the distances between the slot surfaces 66 and 68 is smaller on the first edge 70 of the slot 58, the first edge 70 of the slot 58 will compress the conductor at a faster rate than the second edge 72 of the slot 58 as the conductor travels toward closed end 64. Once enough force is applied to the conductor to compress and lodge it within slot surfaces 66 and 68, the conductor will be compressed to such a point on first edge 70 that the unlodged portion of the conductor extending from the slot 58 will be cleaved from the lodged portion of the conductor within slot 58.

Figure 8A:
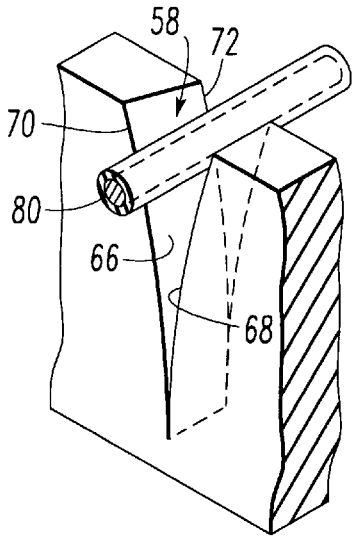
FIGS. 8(A)–8(E) are enlarged, fragmentary, perspective views from the open end of the slot of a wire conductor being positioned in sections of the slot of the electrical conductor terminal, wherein the sections are taken generally along lines I—I, II—II, III—III, IV—IV and V—V of FIG. 7.
Figure 8B:
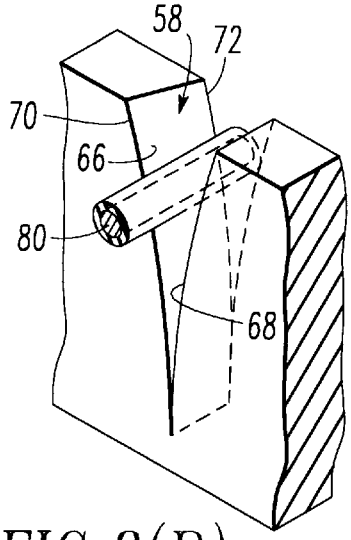
Figure 8C:
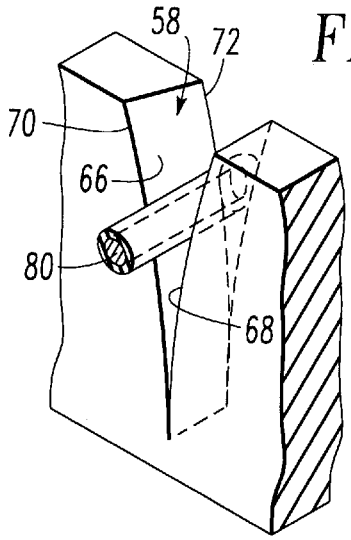
Figure 8D:
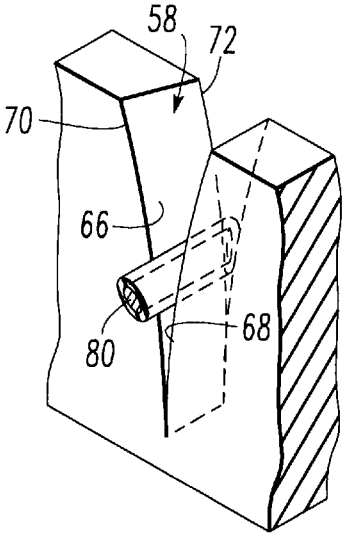
Figure 8E:
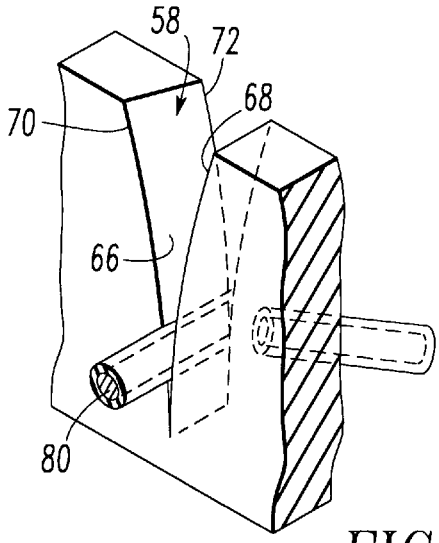

The slot 58 exerts cleaving action on the conductor because the first edge 70 of the slot 58 ends before the second edge 72. FIGS. 8(A)–8(E), which illustrate the progression of the electrical conductor 80 being forced through slot 58, show an insulated wire conductor 80 at various points in the slot 58 during installation of the conductor 80, wherein FIGS. 8(A)–8(E) are perspective views looking from the open end 62 of the slot 58 toward closed end 64. FIGS. 8(A)–8(E) are taken generally along lines I–V of FIG. 7, respectively and depict the two dimensional tapering of slot 58 from both a top of the slot toward a bottom of the slot and from a front of the slot toward a back of the slot. While only a portion of the conductor 80 is shown in the Figures, it is understood that the conductor 80 is an elongated wire which extends in both directions beyond the portion of the conductor 80 shown. As the conductor 80 moves toward closed end 64 of slot 58, the tapered slot surfaces 66 and 68 gradually compress the conductor 80, until, as can be seen in FIG. 8(E), the unlodged portion 82 of the conductor 80 is cleaved from the lodged portion 84. Consequently, if the conductor 80 has not already cleaved as the result of being compressed by the time it reaches the region where the first edge 70 of the slot 58 terminates (shown in FIG. 8(E)), then the force being applied on the conductor 80 will be concentrated on the portion of the conductor 80 which contacts the slot surfaces 66 and 68 between edge 70. This concentration of force exerts a cleaving action on the conductor 80 that facilitates cleaving or termination of the conductor in slot 58.

In an alternative embodiment of the present invention, a cutting device such as a sharp blade may be positioned adjacent to the closed end 64 of slot 58 on the first edge 70 of the slot 58 in order to facilitate the cleaving of the conductor 80 as it is forced into slot 58. The cutting device may be used in conjunction with the cleaving embodiment discussed above, wherein both the cutting device and the tapered slot surfaces 66 and 68 serve to cleave the conductor. Alternatively, the cutting device may be used in electrical conductor terminal 50 having a slot 58 with slot surfaces 66 and 68 which do not approach the first edge 70 along an asymptotic curve, but rather where the distance between slot surfaces 66 and 68 is the same for first edge 70 as second edge 72. In this alternative embodiment, it is the cutting device and not the tapered slot surfaces 66 and 68 which perform the cleaving of the conductor 80.

Figure 9A:
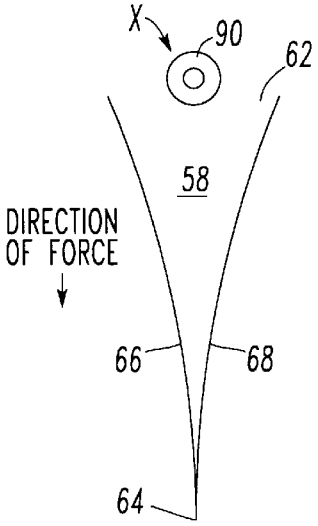
FIG. 9(A)–9(J) are enlarged, fragmentary, cross-sectional views of the path of a wire conductor as it is positioned within the slot of the electrical conductor terminal.
Figure 9B:
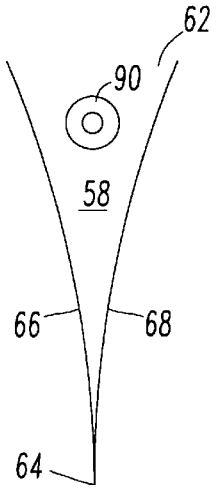
Figure 9C:
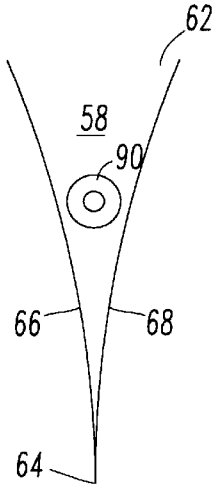
Figure 9D:
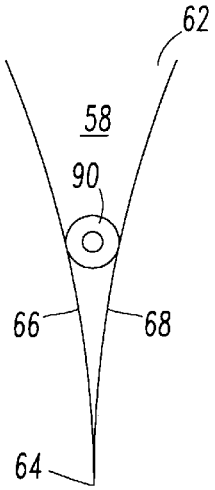
Figure 9E:
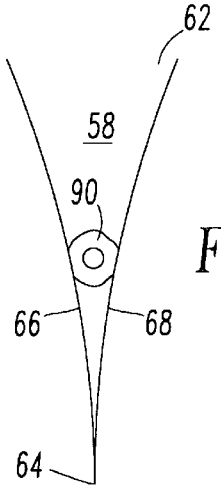
Figure 9F:
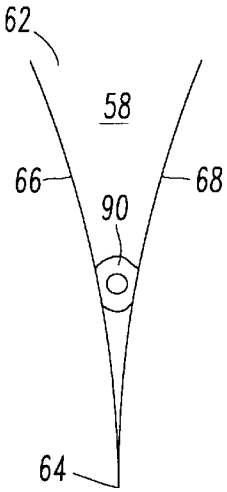
Figure 9G:
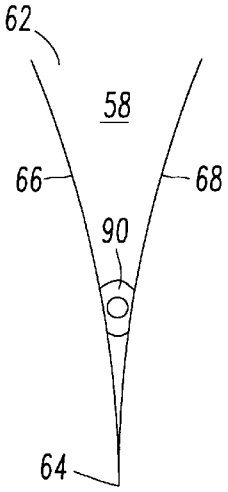
Figure 9H:
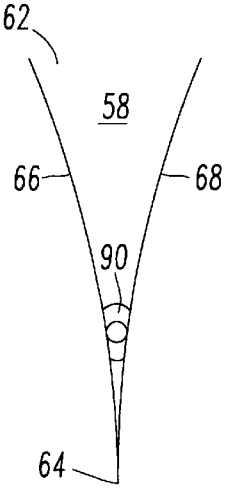
Figure 9I:
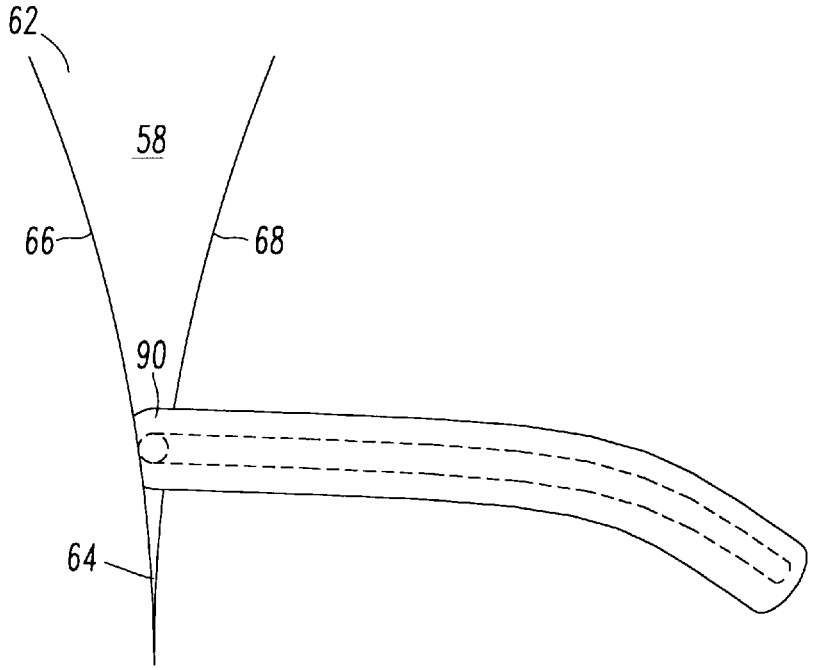
Figure 9J:
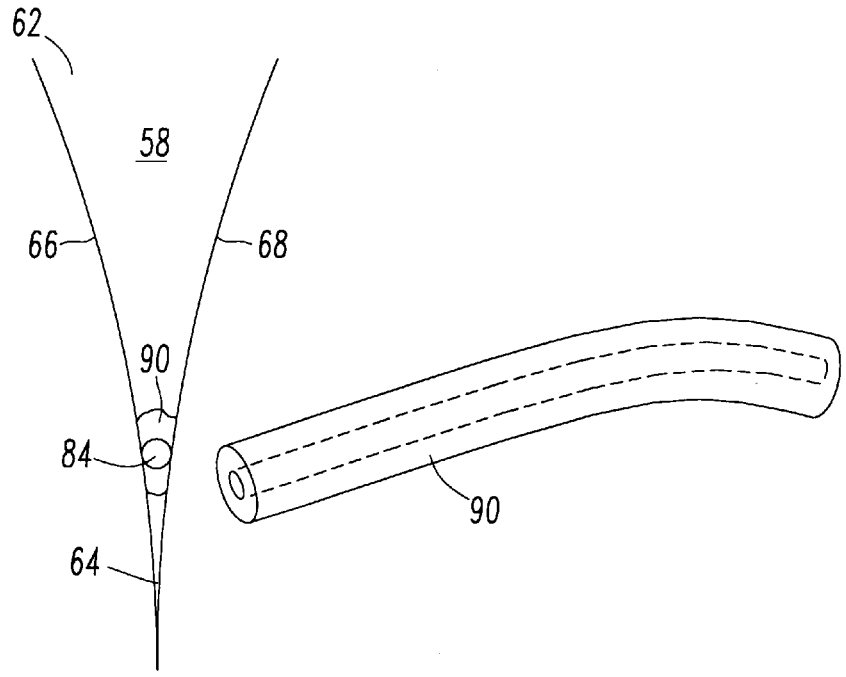

When an insulated conductor 80 is forced into slot 58, the insulation surrounding the conductor 80 is stripped away from the conductor as the result of compression applied by slot surfaces 66 and 68. Referring now to FIG. 9, the compression of the conductor 80 and displacement of the insulation 90 is illustrated in a step-by-step progression through slot 58. As can be seen in FIG. 9(E), the insulation 90 is first compressed by slot surfaces 66 and 68 and stripped from the sides of the wire conductor 92 until the wire conductor 92 comes into contact with slot surfaces 66 and 68. As the conductor 80 continues to be forced toward the closed end 64 of the slot 58, the wire conductor 92 also becomes compressed. Once the wire conductor 92 is fully compressed with slot 58, any additional force on the conductor 80 in the direction of closed end 64 will cleave the unlodged portion 82 of the conductor from the lodged portion 84 as described above. Thus, it is not necessary to strip insulation from an insulated conductor 80 before connecting it to the terminal 50 of the present invention. The stripping action of slot 58 may be improved by providing slot surfaces 66 and 68 with a rough surface finish. In addition to improving the stripping action, a rough surface finish also strengthens the mechanical bond between slot surfaces 66 and 68 and the wire conductor 92 when the wire conductor 92 is lodged in slot 58 to create an electrical connection, because the surface area of surfaces 66 and 68 are thereby increased. Consequently, the integrity of the electrical connection is improved. A suitably rough surface finish may be obtained by mechanically roughening, coating, or anodizing slot surfaces 66 and 68, wherein anodizing is the preferred method of roughening slot surfaces 66 and 68.

Figure 10:
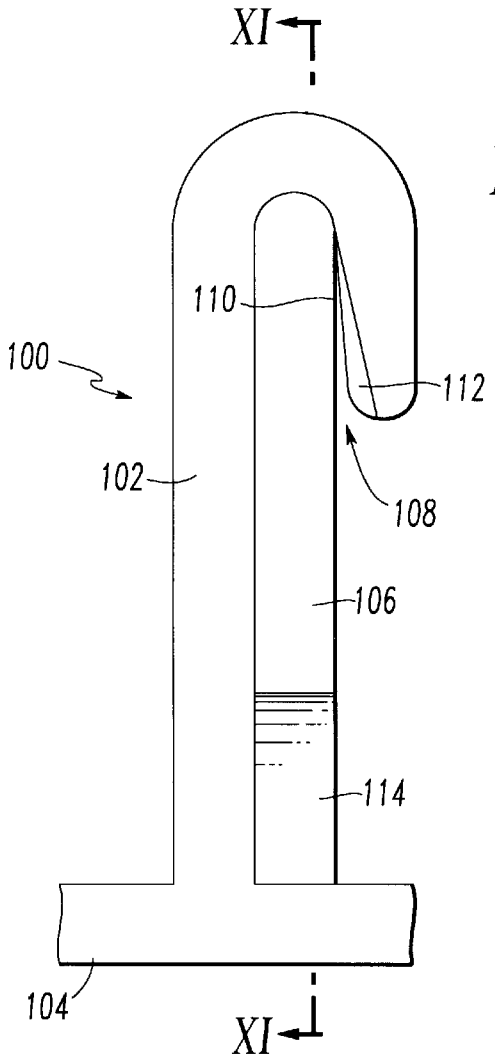
FIG. 10 is a perspective view of an individual electrical conductor terminal in accordance with an alternative preferred embodiment of the present invention.
Figure 11:
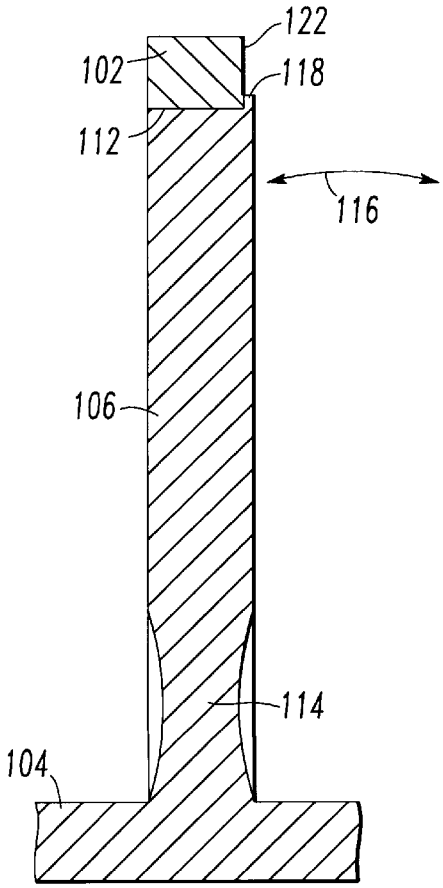
FIG. 11 is a cross-sectional, side view of the alternative embodiment of the electrical conductor terminal taken generally along lines XI—XI of FIG. 10.

Referring now to FIGS. 10 and 11, an alternative embodiment of the electrical conductor terminal 100 is illustrated having a release mechanism for releasing the wire conductor 80 from its lodged connection within slot 58. The terminal 100 includes a support post 102, base 104, and a movable tab 106, wherein the support post 102 is curved so as to form a slot 108. The movable tab 106 extends from the base 104 adjacent to support post 102 and into slot 108. The slot 108 is shaped similarly with slot 58 described above in connection with the previous embodiments and functions equivalently as slot 58 as the electrical conductor 80 is inserted therein. However, in this embodiment, movable tab 106 will form one of the slot surfaces 110 while the other slot surface 112 is formed on the support post 102. Since the conductor 80 must be compressed and sheared within the slot 108, the tab 106 is substantially immobile in the lateral direction of the slot 108 toward support post 102 in order to retain a compressive force on the conductor 80 during connection. The tab 106 abuts support post 102 on its side opposite of slot 108 for additional lateral support toward slot 108, wherein the shape of the tab 106 conforms to the curved shape of the support post 102. The tab 106 is further movable in the longitudinal direction of the slot 108 in order to simply remove a lodged conductor 80 from its connection with slot 108, and allows the terminal to be reused. Once the tab 106 is moved out of slot 108, there will no longer be compressive forces acting on the conductor 80, and the conductor 80 is released from its connection with slot 108. The tab 106 allows the conductor 80 to be easily removed without the use of an additional tool, which improves the efficiency and speed with which the conductor 80 can be removed and replaced.

The tab 106 is devised to be movable along the longitudinal direction of the slot 108 by thinning a lower portion of the tab at 114 along the lateral direction of the slot 108. This thinner portion 114 of the tab 106 provides a pivotal point from which the tab 106 may be bent and be moved in the longitudinal direction of the slot 108, as indication by arrows 116. However, the tab 106 is not thinned along the longitudinal direction of the slot 108 so that the tab 106 is substantially stationary with respect to the lateral direction of the slot 108.

In order to ensure that slot 108 properly and precisely compresses and cleaves a conductor 80 each and every time after the tab 106 is moved to release a previously connected conductor 80, the tab 106 must return to its original resting position. The tab 106 is intended. to have spring tension against the support post 102 in a longitudinal direction of the slot 108; i.e., the tab 106 is biased against side surface 122 of post 102. With the use this biasing, the return positioning is ensured by providing a crown 118 extending from the top surface 120 on one side of the tab 106, wherein the crown 118 abuts a side surface 122 of support post 102 when the tab 106 is in its original resting position. Therefore, the tab 106 may be moved along path 116 with crown 118 moving away from the side surface 122 of support post 102; however, crown 118 will stop movement of the tab 106 in the opposite direction with the crown 118 moving toward side surface 122 when the crown comes into abutment with side surface 122. Thus, the spring tension on tab 106 and crown 118 ensure that tab 106 always returns to its original resting position.

In accordance with the invention, force is applied on the conductor in a direction away from the base, the force being sufficient to lodge the conductor in the slot to create an electrical connection. Force can be applied on a conductor in a direction away from the base, by pulling the conductor by hand toward closed end of slot. As the conductor is pulled into the slot, it is compressed by slot surfaces. For common conductors comprised, for example, primarily of copper, sufficient force can be generated by hand to compress the conductor so that it is firmly and securely lodged in the slot and a stable electrical connection is created. The force on the conductor is maintained until the conductor is cleaved by the slot. Common small gage conductors comprised primarily of copper cleave very quickly, usually within approximately one or two seconds, depending on the amount of force applied.

Once a conductor is installed and terminated in the terminal, it may be simply removed from its connection by applying force on the movable tab along a longitudinal direction of the slot. The tab will then be moved until it is no longer adjacent to the support post, at which point in time compressive forces acting on the conductor are released and the conductor is dislodged.

Figure 12:
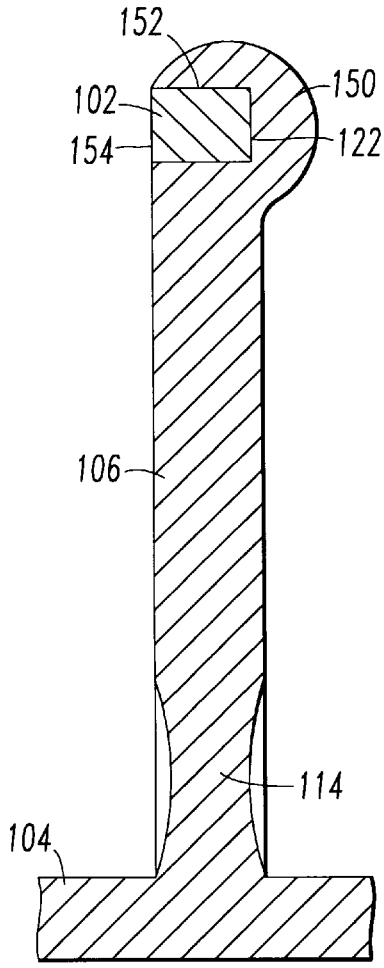
FIG. 12 is a cross-sectional, side view of an alternative embodiment of the electrical conductor terminal shown in FIG. 11.
Figure 13:
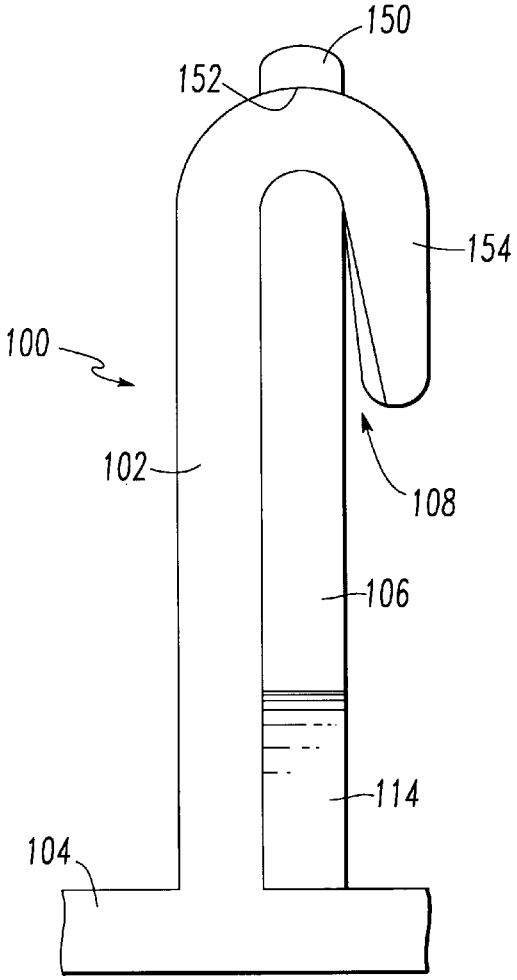
FIG. 13 is a perspective view of the alternative embodiment of the electrical conductor terminal shown in FIG. 12.

Referring now to FIG. 12, an alterative embodiment of the present invention is illustrated in which the tab 106 extends around support post 102. The tab 106 includes a curved extension 150 extending around the side surface 122 and top surface 152 of support post 102, wherein the inner surface of curved extension 150 has the same contour as support post 102 so that the inner surface of the curved extension 150 abuts both the side surface 122 and top surface 152 of support post 102. By abutting side surface 122, curved extension 150 functions similarly as crown 118 to prevent movement of the tab 106 toward the side surface 154 of support post 102 after curved extension 150 comes into abutment with side surface 122. Additionally, by abutting the top surface 152 of support post 102, curved projection 150 also provides additional support for the support post 102 in a direction away from base 104. Therefore, as an electrical connector 80 is lodged in slot 108, the additional support supplied by curved projection 150 assists in preventing support post 102 from being bent or deformed by the upward force exerted on the support post 102 in lodging the electrical connector 80 in slot 108. As can be seen from FIG. 13, curved projection 150 includes the same curvature as the top surface 152 of support post 102 so that the support provided by curved projection 150 is distributed throughout its inner surface.

Referring now to FIG. 14, a further feature of the present invention is illustrated in the form of a wire shaper 200. Often, especially in the telephone industry, a pair of wires are twisted together to provide two separate conductive paths along the twisted wire pair. Therefore, in order to connect the separate wires to the conductor terminal as described hereinabove, the installer must untwist the wires and then connect the two wires to their respective terminals separately. This process is not only time consuming for the installer, but also can be painful to the fingers of the installer when having to grab and separate a large quantity of twisted wires. The wire shaper 200 alleviates this problem by separating a portion of the twisted wire pair and shaping the wires to retain this separated position so that both wires can be installed into their respective terminals at substantially the same time. This is accomplished by providing a wire shaper 200 which gradually increases in size moving from its apex 202 to its base 204. The wire shaper 200 may include a pyramidal shape, as shown in FIG. 14, or any other shape which increases in size moving from the top of the wire shaper 200 toward its base 204. The installer simply grasps the twisted wire pair and imparts a rotational force on the wires in a direction opposite to that of the twisted direction so as to untwist a portion of the wire pair. This untwisted portion is then forced over the wire shaper 200 to separate and shape the wires a desired distance from one another so that this untwisted portion of the wires may be inserted into two terminals with the same motion by the installer. Therefore, this allows two wires to be connected to their respective terminals at substantially the same time, thus dramatically reducing the time and effort required by the installer.

An alternative embodiment of a wire shaper 210 of the present invention is illustrated in FIG. 15. Wire shaper 210 further includes two guiding walls 212 positioned on opposite sides of the wire shaper 210 from one another, wherein guiding walls 212 direct the untwisted portion of the wires into their respective channels 214 where they are shaped by wire shaper 210. Again, it can be seen from FIG. 15 that wire shaper 210 gradually increases in width and length as it moves from its apex 216 to its base 218.

The wire shapers 200 are positioned on non-conductive supporting structure 220, wherein wire shapers 200 and may be integrally formed with supporting structure 220 or may just be attached to the supporting structure 220. Referring now to FIG. 16, the wire shapers 200 are preferably positioned about the four corners 222, 224, 226 and 228 of supporting structure 220 so that a wire shaper 200 is in close proximity to all of the rows of support posts 60, no matter which direction the rows 60 are extending. Therefore, as the installer is running the wire conductor 80 to a support post 54, the installer can choose the most conveniently accessible wire shaper 200 to use.

Figure 17:
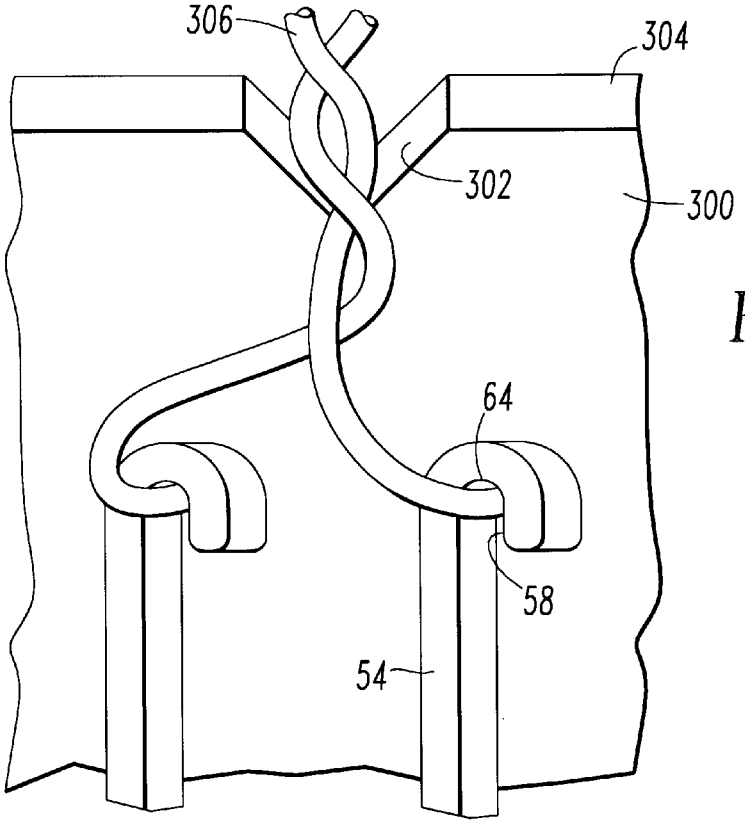
FIG. 17 is a perspective view of a pair of electrical conductor terminals in accordance with an alternative preferred embodiment of the supporting structure of the present invention.
Figure 18:
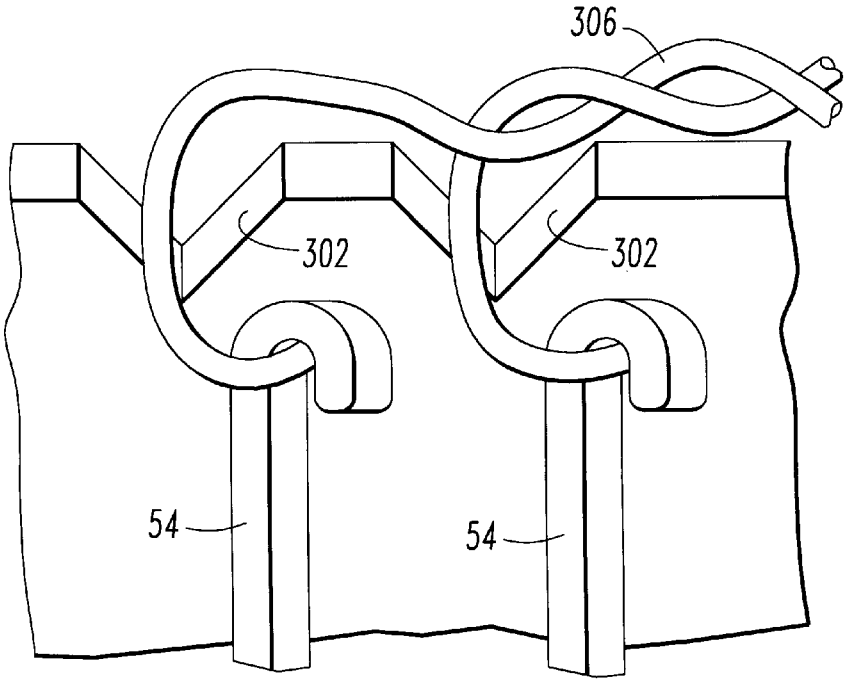
FIG. 18 is a perspective view of a pair of electrical conductor terminals in accordance with another alternative preferred embodiment of the supporting structure of the present invention.

Referring now to FIG. 17, an alternative embodiment of the present invention is illustrated showing a raised portion 300 of the supporting structure 220 extending above support posts 54 in height. The raised portion 300 includes a recess 302 formed in the top surface 304 of the raised portion for receiving an electrical conductor 80 or a twisted wire pair 306 (as shown). Since raised portion 300 is greater in height than support posts 54, the wires 306 must extend down from the recess 302 toward the base 52 in order to be received within the slot 58. A user installs the wires by positioning the twisted wire pair 306 into recess 302 and then positioning the wires into their respective slots 58, before exerting a force in a direction toward the closed end 64 of the slot 58 and thus in a direction toward the height of the top surface 304. By having the wire travel downward toward the slot 58 and then pulling up on the wire on the other side of the slot 58, a substantial angle is created in the wire. This angle created in the wire assists in lodging the wire in the slot 58 and further assists in the cleaving action of the slot 58 on the wire. In this embodiment the twisted wire pair 306 is positioned within recess 302 formed adjacent to two support posts, where the wires are separated after leaving the recess 302. Alternatively, a recess 302 may be formed adjacent to each support post 54 (or row of support posts 60) where the wire has already been separated from the twisted wire pair 306 prior to being positioned within the recess 302, as illustrated in FIG. 18.

By forming an electrical conductor terminal in accordance with the present invention as described above, a terminal is provided which allows for rapid and efficient installation of electrical conductors without the use of additional tools. An installer simply disposes the conductor to place the conductor in a position from which the conductor can be firmly and securely lodged in the slot to create a stable electrical connection by applying force on the conductor as will be described below. Accordingly, the conductor need only be disposed in the slot momentarily before force is applied on the conductor. If desired, however, the conductor may be disposed in the slot for a longer period of time by forcing it by hand toward the closed end of the slot until it is compressed just enough to remain partially lodged in the slot without being held or supported by external means. In applications in which a large number of connections must be made, such preliminary positioning is helpful because it allows a conductor to be easily removed from a slot before it has been fully lodged therein in the event that it is determined that one or more conductors must be moved.

As can be seen from the foregoing, an electrical conductor terminal formed in accordance with the present invention allows electrical conductors to be installed in a terminal easily and rapidly. Moreover, by forming an electrical conductor terminal in accordance with the present invention, an insulated conductor may be lodged in the terminal with the insulation being displaced and the unlodged portion of the conductor being cleaved in the same step and motion as the electrical conductor is connected. Additionally, an electrical conductor terminal formed in accordance with the present invention provides a quick and efficient method of removing a previously installed conductor from the terminal without the need for additional removal tools to allow reuse of the terminal. Thus, the terminal can be continuously recycled without any degradation of performance.

What is claimed is:

1. A terminal for connecting electrical conductors, said terminal comprising:

a base; and at least one support post affixed to said base, said support post having a slot for receiving, terminating, and cleaving an electrical conductor, the electrical conductor being lodged in said slot by applying a force on the electrical conductor toward a closed end of said slot to displace insulation surrounding the electrical conductor and to create an electrical connection between the electrical conductor and said support post, said slot being substantially V-shaped and tapering from a top, wider portion to a bottom, narrower portion and further tapering from a back surface to a front surface,wherein said terminal is substantially planar.

2. The terminal for connecting electrical conductors as defined in claim 1, wherein said slot is disposed in said support post such that the electrical conductor is lodged in said slot by applying force on the electrical conductor in a direction away from said base.

3. The terminal for connecting electrical conductors as defined in claim 1, wherein said slot is defined by first and second slot surfaces extending from said front portion of said slot to said back portion of said slot said slot surfaces being roughened to improve the connection between said support post and the electrical conductor.

4. The terminal for connecting electrical conductors as defined in claim 1, wherein said electrical conductor is received in said slot such that said electrical conductor extends in an axial direction from said front portion of said slot to said back portion of said slot.

5. The terminal for connecting electrical conductors as defined in claim 1, further including releasing means for releasing the electrical conductor from its lodged connection with said slot.

6. The terminal for connecting electrical conductors as defined in claim 5, wherein said releasing means comprises an elongated tab extending from said base and positioned adjacent to said support post, said tab being movable in a direction parallel to an axial direction of said electrical conductor but substantially immobile in a direction perpendicular to said axial direction.

7. The terminal for connecting electrical conductors as defined in claim 6, wherein said tab includes a projection extending therefrom, said projection being biased against a portion of said support post to prevent movement of said tab toward said front portion of said slot but allow movement toward said back portion of said slot to release the electrical conductor.

8. A terminal for receiving, terminating and cleaving an electrical conductor, said terminal comprising a substantially planar, solid, metallic body member having a front surface, a back surface and a side surface connecting said front and back surfaces, and an angular V-shaped slot formed in said side surface, said V-shaped slot tapering from a top, wider portion near said side surface to a bottom, narrower portion distant from said side surface, and tapering from said back surface to said front surface, said V-shaped slot having a closed end at said bottom portion.

9. The terminal of claim 8, wherein said body member is received in a base such that the electrical conductor is received in said slot by applying force on the electrical conductor in a direction away from said base.

10. The terminal of claim 8, wherein an electrical conductor is received in said V-shaped slot such that said electrical conductor extends in an axial direction from said front surface to said back surface.

11. The terminal of claim 8, wherein said slot displaces insulation surrounding an insulated electrical conductor as the insulated electrical conductor is forced into said slot to ensure a connection between the insulated electrical conductor and said metallic body member.

12. The terminal of claim 8, wherein said slot is defined by first and second slot surfaces extending from said front surface to said back surface, said first and second slot surfaces being roughened to improve the connection between said metallic body and the electrical conductor.

13. An electrical terminal for simultaneously terminating and cleaving an electrical conductor, said terminal being substantially planar and comprising a conductor receiving slot having a top, a bottom, a front and a back, said slot tapering in a direction from said front to said back and in a direction from said top to said bottom, said slot being closed at said bottom whereby said slot compresses and cleaves a conductor forced into said slot.

14. The electrical terminal of claim 13, wherein said slot displaces insulation surrounding an insulated electrical conductor as the insulated electrical conductor is forced into said slot to ensure a connection between the insulated electrical conductor and said metallic body member.

15. The electrical terminal of claim 13, wherein said slot is substantially V-shaped.

16. The electrical terminal of claim 15, wherein an electrical conductor is received in said V-shaped slot such that said electrical conductor extends in an axial direction from said front to said back of said slot.

* * * * *